US012053092B1

(12) United States Patent
Stewart, Jr.

(10) Patent No.: US 12,053,092 B1
(45) **Date of Patent: *Aug. 6, 2024**

(54) COMPRESSIBLE FOAM FOUNDATION FOR MATTRESS SUPPORT

(71) Applicant: Mattress Angel, LLC, Jackson, MO (US)

(72) Inventor: James O. Stewart, Jr., Jackson, MO (US)

(73) Assignee: Mattress Angel, LLC, Jackson, MO (US)

( * ) Notice: Subject to any disclaimer, the term of this patent is extended or adjusted under 35 U.S.C. 154(b) by 562 days.

This patent is subject to a terminal disclaimer.

(21) Appl. No.: 17/322,381

(22) Filed: May 17, 2021

Related U.S. Application Data

(63) Continuation-in-part of application No. 17/176,132, filed on Feb. 15, 2021, and a continuation-in-part of (Continued)

(51) Int. Cl.
*A47C 19/12* (2006.01)
*A47C 19/00* (2006.01)

(Continued)

(52) U.S. Cl.
CPC ..... *A47C 19/12* (2013.01); *A47C 19/025* (2013.01); *A47C 23/005* (2013.01); *A47C 27/16* (2013.01);

(Continued)

(58) Field of Classification Search
CPC ... A47C 19/021; A47C 19/025; A47C 19/024; A47C 19/027; A47C 19/00;

(Continued)

(56) References Cited

U.S. PATENT DOCUMENTS 2,551,976 A * 5/1951 Smith ..... A47C 19/027 5/236.1
2,878,494 A * 3/1959 Healy ..... A47C 27/16 5/722

(Continued)

*Primary Examiner* — Justin C Mikowski
*Assistant Examiner* — Morgan J McClure
(74) *Attorney, Agent, or Firm* — CreatiVenture Law, LLC; Dennis JM Donahue, III

(57) ABSTRACT

A foundation for a mattress is formed from one or more single-layer, unitary foam blocks with supports that extend across each foam block's bottom side. The supports provide lateral or longitudinal crosswise support across a bed frame and can be directly attached to the foam block or may be provided in a kit or separately sourced. Legs can be attached to the crosswise supports. The foam block is rigid enough to support a mattress and is compressible so it has a compressed configuration and an expanded configuration, and its bottom side may have channels for the supports. In the compressed configuration, the foundation may be folded and vacuum-sealed in a plastic membrane which provides benefits for storing, shipping, and delivering the foundation. When the foundation is delivered to its place of use, the compressed foundation is removed from its packaging, allowing the foam block to return to its expanded configuration.

20 Claims, 9 Drawing Sheets

Related U.S. Application Data application No. 16/664,840, filed on Oct. 26, 2019, now Pat. No. 11,006,762, which is a continuation-in-part of application No. PCT/US2018/029412, filed on Apr. 25, 2018, which is a continuation-in-part of application No. 15/694,057, filed on Sep. 1, 2017, now Pat. No. 10,165,865, which is a continuation of application No. 15/499,077, filed on Apr. 27, 2017, now Pat. No. 9,756,951, said application No. PCT/US2018/029412 is a continuation-in-part of application No. 15/499,077, filed on Apr. 27, 2017, now Pat. No. 9,756,951.

(60) Provisional application No. 62/988,935, filed on Mar. 13, 2020, provisional application No. 62/977,053, filed on Feb. 14, 2020, provisional application No. 62/415,534, filed on Nov. 1, 2016.

(51) Int. Cl.

| | |
|---|---|
| ***A47C 19/02*** | (2006.01) |
| ***A47C 23/00*** | (2006.01) |
| ***A47C 23/06*** | (2006.01) |
| ***A47C 27/16*** | (2006.01) |
| ***A47C 31/00*** | (2006.01) |

(52) U.S. Cl.

CPC ..... *A47C 31/001* (2013.01); *A47C 19/00* (2013.01); *A47C 19/021* (2013.01); *A47C 23/00* (2013.01); *A47C 23/007* (2013.01); *A47C 23/06* (2013.01)

(58) Field of Classification Search

CPC ..... A47C 19/122; A47C 19/124; A47C 19/12; A47C 27/16; A47C 23/00; A47C 23/007; A47C 23/005; A47C 23/06; A47C 23/061; A47C 23/062; A47C 23/068; A47C 31/001

See application file for complete search history.

(56) References Cited

U.S. PATENT DOCUMENTS 3,146,469 A * 9/1964 Slade ..... A47C 27/15 5/699
3,724,009 A * 4/1973 Ambrose ..... A47C 31/02 428/40.1
3,837,020 A * 9/1974 Bosch ..... A47C 27/15 5/411
3,842,451 A * 10/1974 McCormick ..... A47C 19/021 5/264.1
3,846,857 A * 11/1974 Weinstock ..... A47C 27/15 5/722
3,848,283 A * 11/1974 Ikeda ..... A47C 27/066 5/717
3,913,154 A * 10/1975 Sweeney ..... A47C 19/025 5/186.1
3,973,281 A * 8/1976 Davis ..... A47C 27/15 297/440.13
4,106,139 A * 8/1978 Southard ..... A47C 23/00 5/186.1
4,229,847 A * 10/1980 Degen ..... B32B 5/245 5/724
4,316,298 A * 2/1982 Russo ..... A47C 27/001 5/691
4,535,494 A * 8/1985 Diamonstein ..... A47C 23/06 5/200.1
4,692,199 A * 9/1987 Kozlowski ..... B29C 51/365 264/324
4,711,067 A * 12/1987 Magni ..... B65B 63/02 53/430
4,795,517 A * 1/1989 Elliott ..... B29C 65/305 264/249
4,928,337 A * 5/1990 Chauncey ..... A47C 27/001 5/722
4,975,135 A * 12/1990 Lowe ..... B60N 2/7017 297/DIG. 2
5,231,717 A * 8/1993 Scott ..... A47C 31/123 5/400
5,504,952 A * 4/1996 Ovadia ..... A47C 27/148 5/236.1
5,513,402 A * 5/1996 Schwartz ..... A47C 27/001 5/691
5,671,492 A * 9/1997 Simon ..... A47C 27/15 5/736
5,681,090 A * 10/1997 St. Thomas ..... A47C 5/12 297/452.17
5,745,940 A * 5/1998 Roberts ..... A47C 27/001 5/737
5,960,496 A * 10/1999 Boyd ..... A47C 27/18 5/931
6,085,373 A * 7/2000 Montana ..... A47C 27/144 5/722
6,115,861 A * 9/2000 Reeder ..... A61G 7/05776 5/722
6,662,393 B2 * 12/2003 Boyd ..... A47C 27/148 5/727
6,739,008 B1 * 5/2004 Kindrick ..... A47C 27/146 5/730
7,140,053 B1 * 11/2006 Mangano ..... A47G 9/02 5/493
7,200,884 B2 * 4/2007 Wright ..... A47C 27/001 5/717
7,334,280 B1 * 2/2008 Swartzburg ..... A47C 21/046 5/724
7,469,437 B2 * 12/2008 Mikkelsen ..... A47C 27/148 5/724
7,631,381 B2 * 12/2009 Flippin ..... A47C 27/053 5/721
8,025,964 B2 * 9/2011 Landvik ..... B32B 5/18 428/218
8,443,974 B2 * 5/2013 Oh ..... B65B 25/146 206/394
8,800,082 B2 * 8/2014 Kluft ..... A47C 27/056 5/717
8,935,819 B1 * 1/2015 Hartley ..... A47C 23/061 5/236.1
9,179,782 B2 * 11/2015 Schiller ..... A47C 27/056
9,655,456 B2 * 5/2017 Boyd ..... A47C 27/10
10,165,865 B2 * 1/2019 Stewart, Jr. ..... A47C 23/005
10,548,789 B2 * 2/2020 Dyevich ..... A61G 7/05723
2004/0055086 A1 * 3/2004 Owens, Jr. ..... A47C 19/005 5/400
2004/0074007 A1 * 4/2004 Gladney ..... A47C 27/20 5/718
2004/0139552 A1 * 7/2004 Walters, Jr. ..... A47C 27/008 5/737
2004/0163178 A1 * 8/2004 Corneil ..... A47C 27/088 5/954
2005/0000026 A1 * 1/2005 Gladney ..... A47C 19/021 5/717
2005/0028274 A1 * 2/2005 Hooper ..... A47C 23/00 5/400
2005/0028275 A1 * 2/2005 Hooper ..... A47C 23/05 5/400
2006/0123551 A1 * 6/2006 Hsia ..... A47C 27/081 5/706
2007/0151033 A1 * 7/2007 Wyatt ..... A61G 7/05715 5/713
2008/0172799 A1 * 7/2008 Constantinescu ..... A47C 27/16 5/191
2008/0235868 A1 * 10/2008 Snitzer ..... A47C 19/005 5/400
2009/0025150 A1 * 1/2009 Smalling ..... A47C 23/005 5/718
2009/0183311 A1 * 7/2009 Nguyen ..... A47C 19/021 5/174

(56) References Cited

U.S. PATENT DOCUMENTS

| | | | | |
|---|---|---|---|---|
| 2013/0145555 | A1* | 6/2013 | Hargreaves | A47D 15/001 5/655 |
| 2013/0269107 | A1* | 10/2013 | Fiene | A47G 9/02 5/497 |
| 2014/0304921 | A1* | 10/2014 | Collins | A47C 27/148 5/690 |
| 2015/0015402 | A1* | 1/2015 | Boyd | A47C 27/085 340/626 |
| 2016/0088951 | A1* | 3/2016 | McGuinness | A47C 3/16 5/35 |
| 2016/0157625 | A1* | 6/2016 | Schneider | A47C 27/006 5/699 |
| 2016/0198862 | A1* | 7/2016 | Farley | A47C 27/148 5/727 |
| 2017/0049242 | A1* | 2/2017 | Franken | A47C 31/123 |
| 2017/0079444 | A1* | 3/2017 | Blazar | A47C 27/14 |
| 2018/0027977 | A1* | 2/2018 | Shelby | A47C 19/025 |
| 2018/0049558 | A1* | 2/2018 | Jurcenko | A47G 9/0292 |
| 2018/0092466 | A1* | 4/2018 | Harrow | A47C 19/027 |
| 2018/0116421 | A1* | 5/2018 | Goncalves | A47C 31/004 |
| 2019/0150631 | A1* | 5/2019 | Pearce | B68G 7/00 |
| 2019/0343294 | A1* | 11/2019 | DeMoss | B68G 7/10 |
| 2020/0000243 | A1* | 1/2020 | Andrew | A47C 27/064 |
| 2020/0054147 | A1* | 2/2020 | Stewart, Jr. | A47C 27/16 |
| 2020/0196771 | A1* | 6/2020 | Martin | D04H 1/425 |
| 2021/0076835 | A1* | 3/2021 | Pearce | A47C 27/146 |
| 2021/0120967 | A1* | 4/2021 | Murphy | A47C 27/15 |
| 2021/0251391 | A1* | 8/2021 | Wagner | A47C 27/064 |
| 2022/0031085 | A1* | 2/2022 | Sheikh | A47C 27/144 |
| 2022/0369827 | A1* | 11/2022 | Rose | A47C 27/064 |

* cited by examiner

COMPRESSIBLE FOAM FOUNDATION FOR MATTRESS SUPPORT

CROSS-REFERENCE TO RELATED APPLICATIONS

This application is a continuation-in-part of U.S. patent application Ser. No. 17/176,132 filed on Feb. 15, 2021 which claims priority to U.S. Provisional Pat. App. Nos. 62/977,053 and 62/988,935 respectively filed on Feb. 14, 2020 and Mar. 13, 2020, and is also a continuation-in-part of U.S. patent application Ser. No. 16/664,840 filed on Oct. 26, 2019 which is a continuation-in-part of International App. No. PCT/US18/29412 filed on Apr. 25, 2018, designating the United States and claiming priority to U.S. patent application Ser. Nos. 15/499,077 and 15/694,057 filed on Apr. 27, 2017 and Sep. 1, 2017 and issued on Sep. 12, 2017 and Jan. 1, 2019 as U.S. Pat. Nos. 9,756,951 and 10,165,865, respectively, the former claiming priority to U.S. Provisional Pat. App. No. 62/415,534 filed on Nov. 1, 2016, all of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to foundations for mattresses, and more particularly to foundations made of foam that may be compressed and folded into dimensions more suitable for shipping and storage.

Related Art

Prior art mattress foundations have typically been produced using hard materials like wood and plastic which must be assembled before they are able to support a mattress. These known mattress foundations typically consist of a rectangular frame with a series of slats spanning the width of the rigid frame so that the foundation frame sits on and spans a standard bed frame and a mattress is supported by the slats on the top side of the foundation. Other types of known foundations substitute the series of slats for one or more cross beams or a single panel of rigid material which may be known as a platform mattress foundation. Additionally, some known mattress foundations combine the rigid frame and cross members with supporting springs and are known as "box springs." These box springs are designed to provide more ergonomic support as they may flex when certain amounts of force are applied to the supported mattress, but the rigidity of the frame and stiffness of the springs still prevent folding and compression that equates to the compactness of the compressible foam mattress foundation described herein. Some of these mattress foundations with rigid support members can be disassembled for storage, shipment, and delivery, but these rigid foundations must then be assembled for use.

Some current mattress foundations include foam as a primary support material for the mattress rather than the rectangular frame with slats as described above. However, these foam foundation assemblies include a rigid panel base that spans the entire area within the periphery of the foam block (lengthwise and crosswise). For example, U.S. Pat. No. 4,106,139 discloses a foam foundation, but the panel base connected to the foundation within the cover is rigid and prevents the foundation from being folded for easier shipping and storage. As seen in US Pat. Pub. No. 2004/0055086, separate foam foundation modules have individual panel bases that are connected together by hinged fasteners that allow the modules to be folded. Although adjacent panel bases are connected together by fasteners, foam blocks in adjacent modules are not connected in order to permit the modules' adjacent panel bases to be folded together at the hinged fasteners without folding the foam blocks. The folded foundation modules can be stored, shipped, and delivered and then unfolded when ready for use. The folding of the modules reduces the length of the packaged foundation which helps in the delivery of each foundation but does not necessarily reduce the volume of space it takes for storing and shipping a large group of foundations.

Although the foldable foam-panel modules disclosed by the '086 Application may have an advantage over the unfoldable foam-panel structure disclosed by the '139 Patent by helping in the delivery of foam foundations, it also introduces discontinuities in the support of the mattress because of the multiple sections of foam. None of the prior art references consider using a single, unitary foam block for a foundation with multiple separate support beams that are not directly connected to each other but are only connected to each other through their attachment to the unitary foam block. Prior to the present invention, the conventional thoughts in the bedding industry had been that panels should cover the entire surface area within the periphery of the foam block to properly support the foam block and avoid sagging due to lack of some rigid support across the entire lengthwise and crosswise dimensions of the panel. Even in the '139 Patent which has a corrugated bottom surface with grooves in the surface which do not contact the panel, the panel or some other structural support spans the entire surface area within the foam block's periphery, lengthwise and crosswise, and provides rigidity to the foundation assembly in both the lengthwise and crosswise dimensions.

It has also been known to compress and fold foam mattresses so that they can be stored, shipped, and delivered in a compact form. For example, U.S. Pat. No. 4,711,067 by Magni and US Pat. Pub. No. 2015/0015402 by Boyd each describe compressible mattress variations having fluid chambers for air or other materials that provide skeletal support to the mattress while supporting foam layers and supplemental cushion layers work in concert to provide a comfortable and stable sleeping surface. The '067 Patent particularly describes a mattress that can be compressed and squeezed into an elastic wrapper and subsequently rolled into a more manageable shape for insertion into a shipping container. Although the primary innovation of the '067 Patent is directed to the method for stowing different varieties of mattresses, the mattresses themselves combine various supporting and cushion layers of artificial or natural fibers to ensure the comfort of the user when the mattress is unwrapped.

Similarly, the '402 Application describes a compressible mattress having a foam body made out of a polyurethane, latex, gel-filled or similar viscoelastic foam with elongated chambers filled with gas, liquid, gel or another foam to provide additional rigidity to the mattress structure. However, because the mattress described in the '402 Application must be comfortable to the sleeper while also being sturdy enough to maintain its form, a foam cushion sheet or cover overlays the top of the foam body. In various embodiments of the mattress described in the '402 Application, multiple support and cushion layers having differing indentation force deflections are used together to provide both support and comfort to the sleeper.

Despite these innovations, prior to the present invention, the bedding industry has never been able to both compress and fold foam foundations to the same degree as foam mattresses because the rigid panels or outer rigid framework with interior slats that have traditionally been used for foam foundations had required the rigidity in both the lengthwise and the crosswise dimensions. Similarly, mattresses inherently provide comfort to sleepers and thereby require supporting foam layers along with cushion layers that have differing indentation force deflection to provide both comfort and support. Thus, there has remained a need for a foam foundation that could be folded and compressed to be stored, shipped, and delivered in a compact form and then unfolded and expanded into a usable configuration that provides support to the mattress and has sufficient rigidity spanning the bed frame in either a lengthwise or crosswise dimension to avoid sagging. It would be beneficial to have a compressible foam foundation that does not require a lengthwise and crosswise rigid frame or panels beneath the foam block, or does not require a frame that must be assembled before the foundation can be used to support a mattress on a bed frame.

SUMMARY OF INVENTION

According to the invention described herein, a foundation for a mattress is formed from one or more single-layer, unitary foam blocks made from a single unitary foam material. Lateral or longitudinal crosswise support can be provided and can be directly attached to the underside of the foam block or may be provided in a kit or separately sourced. The foundation may be used with a standard bed from or may include legs that can be attached to the crosswise supports along with optional braces that connect between the legs. The foam block is rigid enough to support a mattress and is compressible so it has a compressed configuration and an expanded configuration, and its bottom side may have channels for the supports. In the compressed configuration, the foundation may be folded and vacuum-sealed in a plastic membrane which provides benefits for storing, shipping, and delivering the foundation. When the foundation is delivered to its place of use, the compressed foundation is removed from its packaging, allowing the foam block to return to its expanded configuration.

In one aspect of the invention, the foam block includes crosswise supports with legs releasably attached to the bottom side of the crosswise supports. One set of legs is proximal to the head side of the foundation while another set is proximal to the foot side of the foundation. Further, additional sets of legs may be provided between the head and foot sets.

In another aspect of the invention with legs connected to the crosswise supports, braces are provided and connect between pairs of legs at opposing brace ends. Preferably, each brace intersects with another crosswise support and is connected thereto or rests there against at a mounting point and thereby provides additional support to the foam block between the legs.

In yet another aspect of the present invention, the foam block consists of single layer of foam material having an IFD between thirty-nine and ninety-five pounds, devoid of any elongated chambers or other cushioning layers. The foam block is subsequently covered and wrapped in an plastic layer and can be shipped in the interior of a shipping container alone or along with separable crosswise supports, legs and braces in the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings which are summarized below.

DETAILED DESCRIPTION OF THE PREFERRED EMBODIMENTS

Figure 1A:
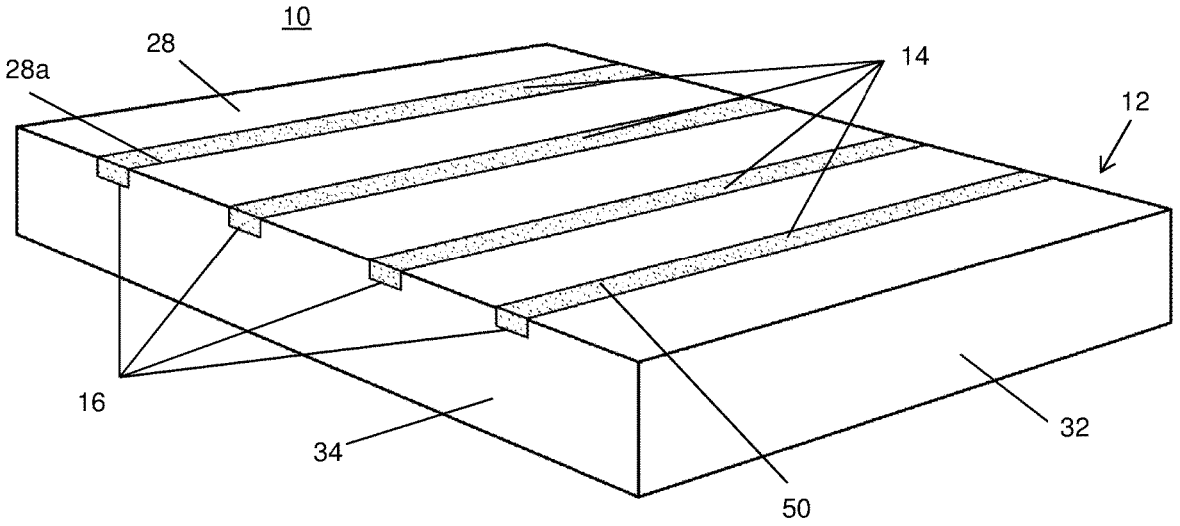
FIG. 1A shows a bottom view of an uncovered foam foundation for a mattress with crosswise supports.

The following description of the preferred embodiment(s) is merely exemplary in nature and is in no way intended to limit the invention, its application, or uses.

A foundation 10 for a mattress made up of a foam block 12 that is preferably a single layer of a unitary foam block that has an internally homogenous structure, i.e., without any internal elongated chamber, space, or other large void within the center portion of the foam block, and that preferably includes a plurality of rigid crosswise supports 14 at the bottom side of the foam block. The foam block is made of a compressible and flexible firm foam 72 having a density of 0.85-5.0 pounds per cubic foot and having an indentation force deflection ("IFD") between thirty-nine and ninety-five (39-95 IFD) which has sufficient firmness and strength to support a mattress but is not rigid so that the foam block may still be compressed and is flexible enough to bend both laterally and longitudinally. The foam is preferably polyurethane or any other firm foam that both compressible and flexible. A lower range IFD of 30-39 would be possible for a lighter weight product but would likely have limited applications, such as for small children or infants.

The foam block has an expanded configuration 42 in which the foam block reaches its full thickness 44*b* and a compressed configuration 40 in which the foam block is pressed down to a reduced thickness 44*a*. The reduced thickness is less than half of the expanded thickness and is preferably between 15% and 25% of the expanded thickness. In the expanded configuration, the foam block supports a mattress and may be produced to the length and width dimensions that accommodate mattresses of various sizes. Typically, these dimensions will conform to traditional mattress and mattress foundation sizes, namely twin, full, queen, king, California king, etc. which typically have a length between seventy-four (74) and eighty (80) inches (74"-80"). However, traditional bedding sizes are not intended to be limiting, and the foundation size may vary in dimension relative to the mattress intended to be supported, including custom dimensions not traditionally used in the bedding industry.

Typically, foundations have a low profile thickness between five and eight inches (5"-8") or a high profile thickness between nine and twelve inches (9"-12") when expanded to their full thickness. When the foam block is compressed, the reduced thickness is approximately between two and three inches (2"-3"). It will be appreciated that the reduced thickness is primarily dependent on the full thickness of the foam block, but the IFD of the foam could also play a factor in the amount to which the foam can be compressed, particularly depending on the equipment that is used to compress the foam. The compression of the foam block is primarily unidirectional so that the compressed configuration and the expanded configuration have nearly the same lateral width 36 between the pair of foundation sides 34 and longitudinal foundation length 38 between the head side 30 and the foot side 32. The foam's IFD is measured using an industry standard technique, such as ASTM D3574 entitled "Standard Test Methods for Flexible Cellular Materials—Slab, Bonded, and Molded Urethane Foams" and published by ASTM International, and the measurement technique for the foam's IFD does not form a part of the present invention.

Another aspect of the foam foundation are the crosswise supports connected to the foam block's bottom side 28. These crosswise rigid supports 14 act as a skeletal structure and provide rigid structure to the foam foundation 10, but the supports are thin enough (less than 2" or 3") to allow the foundation to be compressed to its reduced thickness, and there is no rigid connection between the crosswise supports so that the flexible foam block can be rolled with the rigid supports into the preferred shipping arrangement. Preferably, the crosswise supports in a unitary foam block are only connected to each other through their attachment to the unitary foam block and not through any other structure. The crosswise supports preferably extend laterally across the foam block so that the foam block rolls in the longitudinal direction around the foam block's lateral axis which results in the most compact configuration of the compressed and rolled foam foundation. As described in detail below with regard to FIGS. 8 and 9, it will also be appreciated that longitudinal crosswise supports could also serve as the crosswise rigid supports, in which case the foundation is rolled in the lateral direction around the longitudinal axis.

The crosswise rigid supports may be any number of shapes including but not limited to beams, slats, rods, and planar panels. Additionally, the crosswise supports may be made from any number of rigid materials including but not limited to woods, plastics, metals, hardened foams, composites, and other similar materials. The crosswise supports preferably traverse the entire width of the foundation and are substantially perpendicular to the side edges while remaining substantially parallel to one another. The crosswise supports extend between the sides of the foundation so that they can be placed onto a standard bed frame and provide even support across the span of the bed frame. Preferably, the crosswise supports are connected to the foam block during manufacture prior to shipping, but the foam foundation and crosswise supports can alternatively be shipped together in an unattached arrangement. In another alternative arrangement, foam foundation can be shipped on its own, and a user may provide their own crosswise supports for connection to the foam foundation.

It is generally an aspect of the foam foundation to have crosswise supports spaced apart from each other by a distance 46. The crosswise supports provide crosswise rigidity to the foundation and are flexibly connected to each other through contiguous portions of the single flexible foam block that extend between adjacent crosswise supports; they are not rigidly connected. The spaced distance 46 will vary based on the number of crosswise supports included in the foundation and its size and the shape of the crosswise supports. In spacing the crosswise supports from each other, the distance separating the supports has a range that is greater than the reduced thickness 44*a* of the foam block 12, preferably greater than the foam block's full thickness 44*b*, and less than the foam block's lateral width 36. Increasing the distance reduces the number of crosswise supports which reduces the cost of the foundation and the weight of the foundation. The maximum distance depends on the expanded foam block's strength and firmness and preferably prevents the foam block from sagging between the rigid crosswise supports. The minimum distance depends on the flexibility of the foam, particularly in the compressed configuration and preferably allows the foam block's compressed configuration to be folded. The distance between the crosswise supports should not be increased so much that it results in sagging which could negatively impact the uniform, firm support that is provided to the mattress above the foundation. The distance between the crosswise supports can vary to avoid sagging at the ends of the foundation, such as with the crosswise supports adjacent to the head side and foot side of the foam block being spaced closer to the ends. Preferably, the distance between adjacent crosswise supports in the center section of the foundation is approximately 14.5" and can be as far as 20".

Figure 1B:
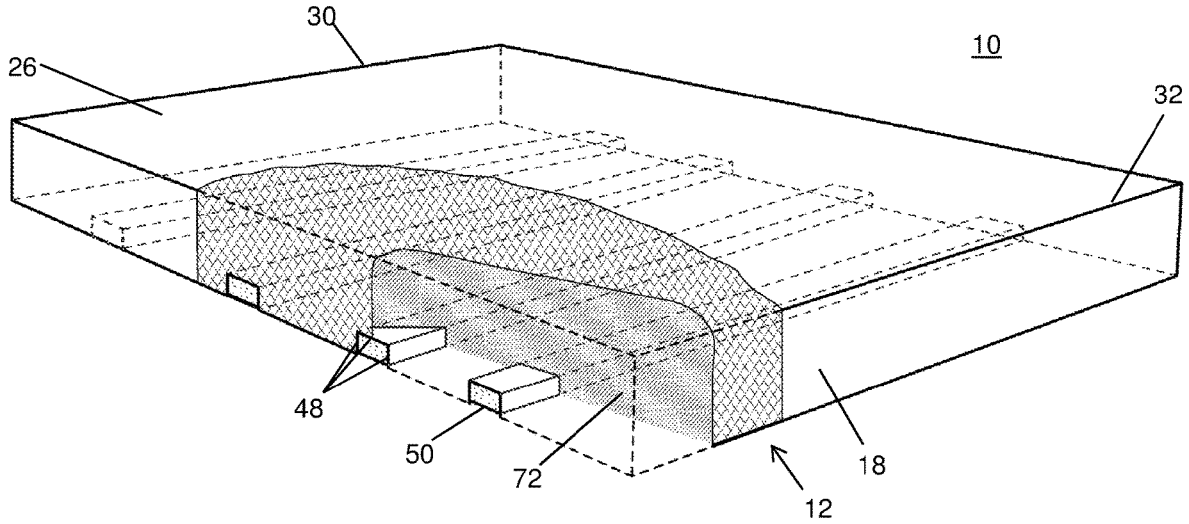
FIG. 1B shows a partial cutaway top view of a foam foundation for a mattress with crosswise supports and a cover.

As shown in FIGS. 1A and 1B, the foam block preferably has channels 16 recessed into its bottom side, and the crosswise supports fit into the channels. The channels can be cut into the bottom side of the foam block or formed into the foam block's bottom side, and in either case, the channels extend the entire width of the foam block between the sides. Additionally, the channels are spaced apart at locations corresponding with the distance between the crosswise supports. Preferably, the dimensions of the crosswise support are substantially equivalent to the channels' dimensions such that the length, width and thickness of the supports are equal to or slightly larger than the channel length, channel width, and channel depth. Accordingly, the crosswise supports can be friction fit 68 within the channels or can be fixed within the channels with an adhesive 66 as the crosswise supports have sides 48 that contact the walls of the channel. The crosswise supports are preferably rectangular or square with four (4) sides, and three (3) of the sides are in contact with the walls of the channels while the fourth outer-facing side 50 is not in contact with any of the channels' walls. It will be appreciated that different shaped crosswise supports may be used, including but not limited to circular supports or triangular supports, but the outer-facing sides are preferably flush with the foam foundation's bottom surface 28*a* when in the expanded configuration.

According to the embodiment shown in FIG. 2, the foam foundation 10 does not have channels 16 recessed into its bottom side 28, and narrow crosswise supports 14 can be connected directly to the foundation's bottom surface 28*a* with an adhesive 66. In this embodiment, the crosswise supports are preferably planar in shape and are attached to the bottom surface of the foam foundation along a single side. It will be appreciated that supports having a non-planar shape can also be used. Accordingly, the crosswise supports in this embodiment may not be substantially flush with the bottom surface of the foam foundation. The foam foundation and crosswise supports may be attached during manufacture, shipped as a kit, or assembled from separately sourced parts.

Figure 2A:
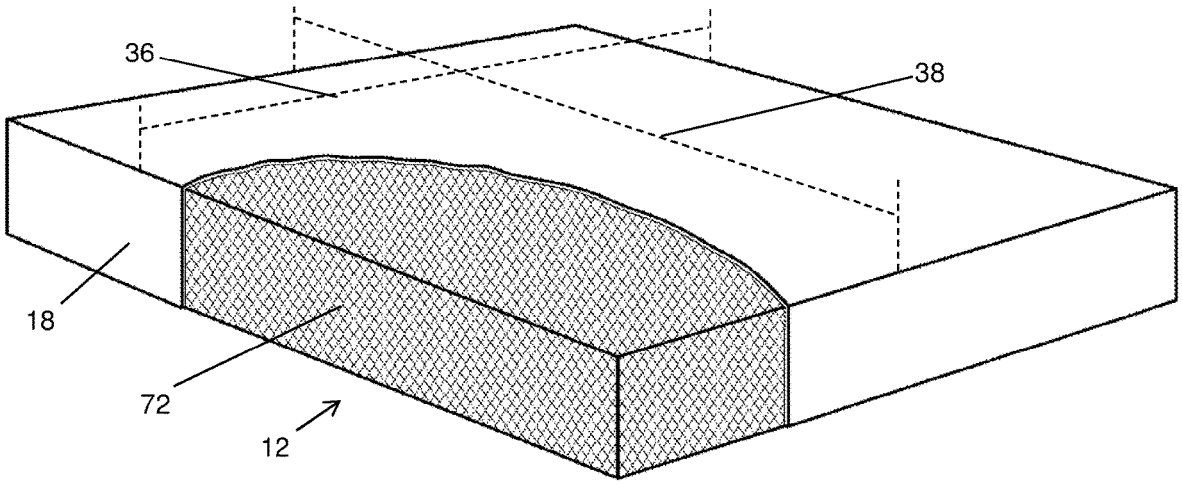
FIG. 2A shows a partial cutaway top view of a covered foam foundation for a mattress without crosswise supports.
Figure 2B:
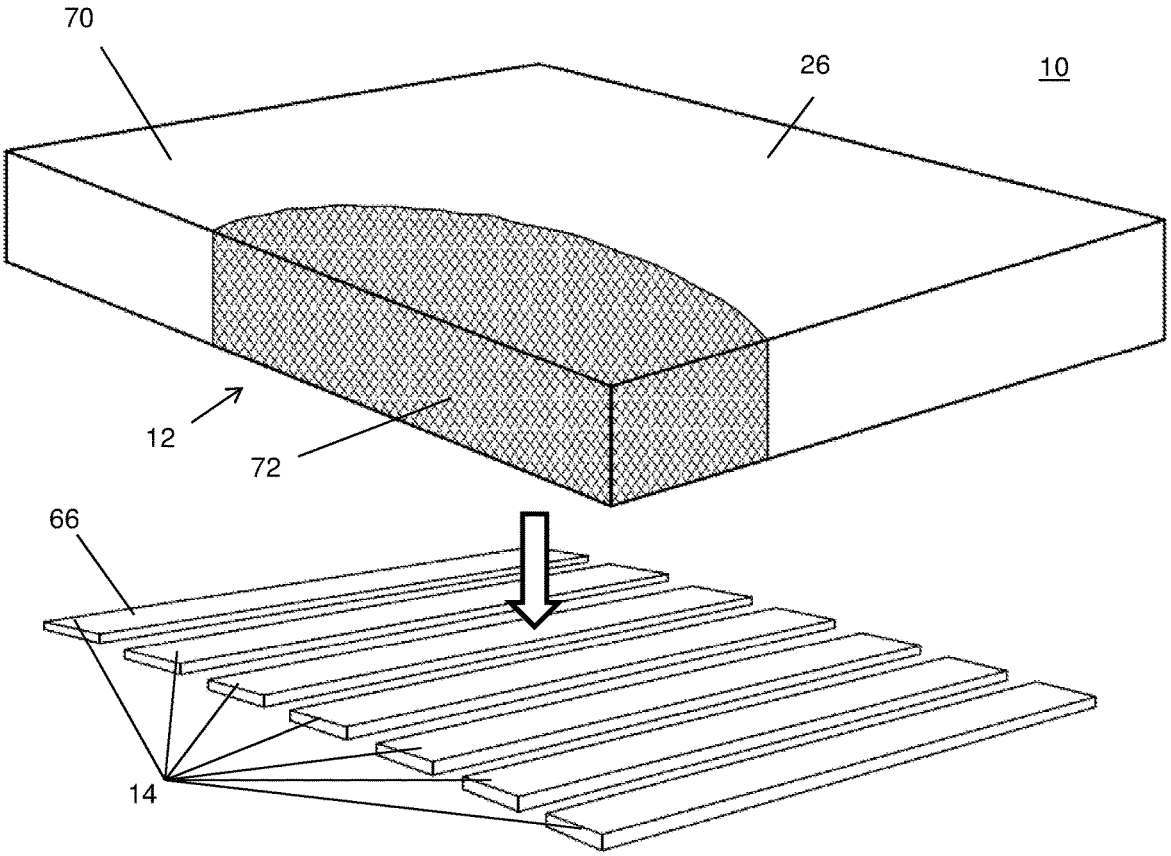
FIG. 2B shows a partial cutaway top exploded view of a foam foundation for a mattress with crosswise supports and a cover.

In another aspect of the present invention, a cover 18 envelops the foam block 12 as shown in FIGS. 1B, 2A, and 2B and also preferably envelops the crosswise supports 14 as shown in FIG. 1B. In yet another aspect of the present invention, the compressed configuration of the foam foundation 10 is encased by a plastic membrane 20 as shown in FIG. 3C. Accordingly, the foam block, cover and plastic membrane collectively form the packaged foundation assembly 58 discussed below. The cover is preferably removable to allow easy washing and replacement, but it may alternatively be permanently sewn over the foam block and crosswise supports. Different fasteners can be used to secure a removable cover around the foundation, including but not limited to zippers, hook and loop fasteners, snaps, buttons, and other similar closing and securing means. The cover is preferably made from a flame retardant material 70 or a material or combination of materials that pass or exceed the Federal Law 16 C.F.R. 1633 flammability standard to help make the foam foundation flame retardant.

Figure 3A:
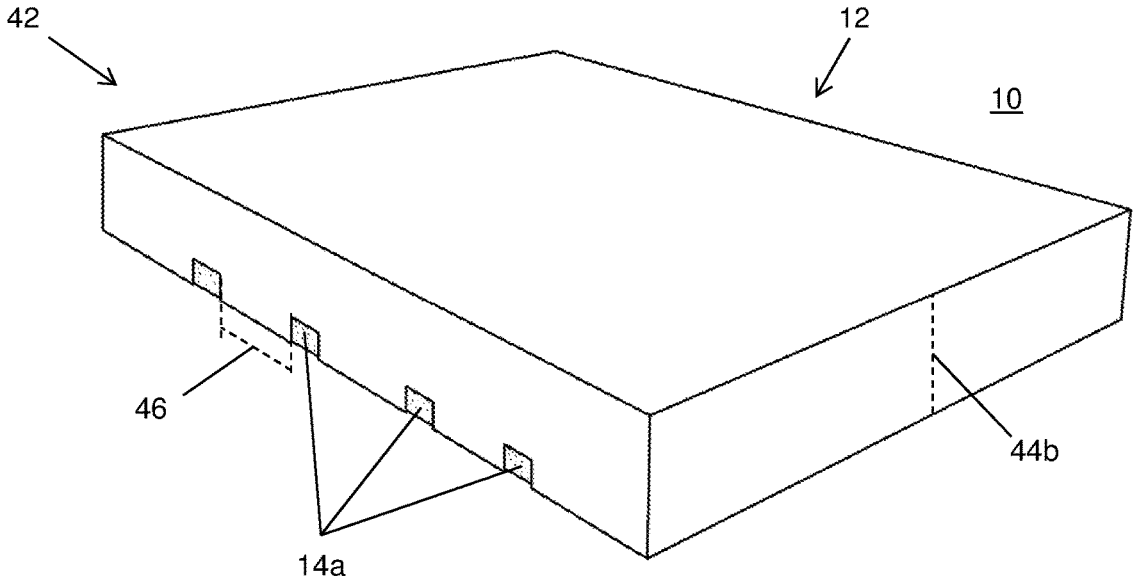
FIG. 3A shows a foam foundation for a mattress in the expanded configuration.
Figure 3B:
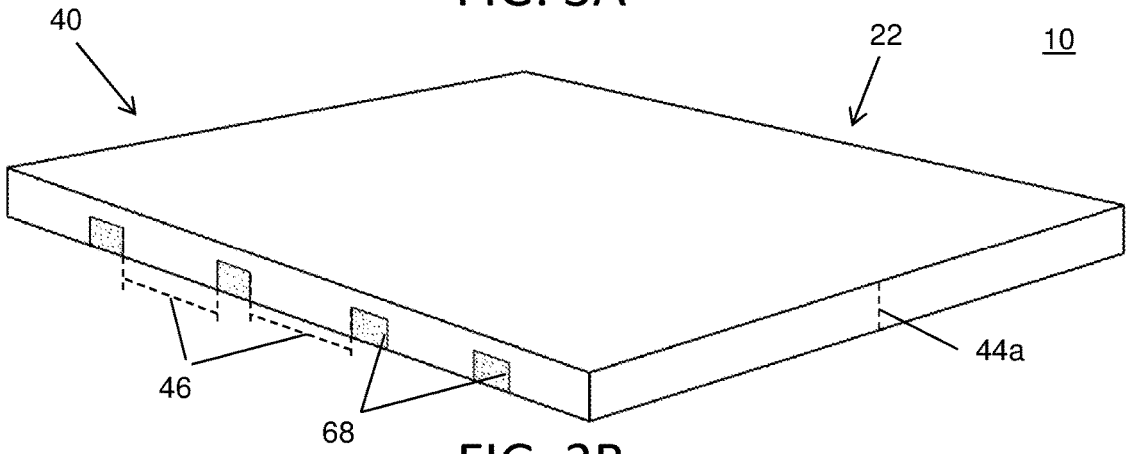
FIG. 3B shows a foam foundation for a mattress in the compressed configuration.
Figure 3C:
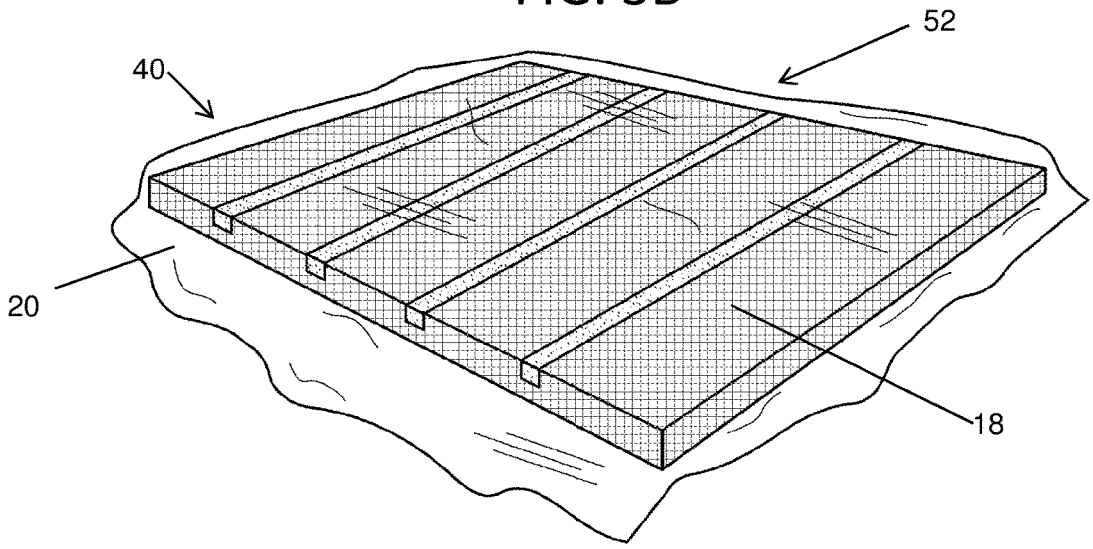
FIG. 3C shows a foam foundation for a mattress in the compressed configuration encased in a plastic membrane.
Figure 4A:
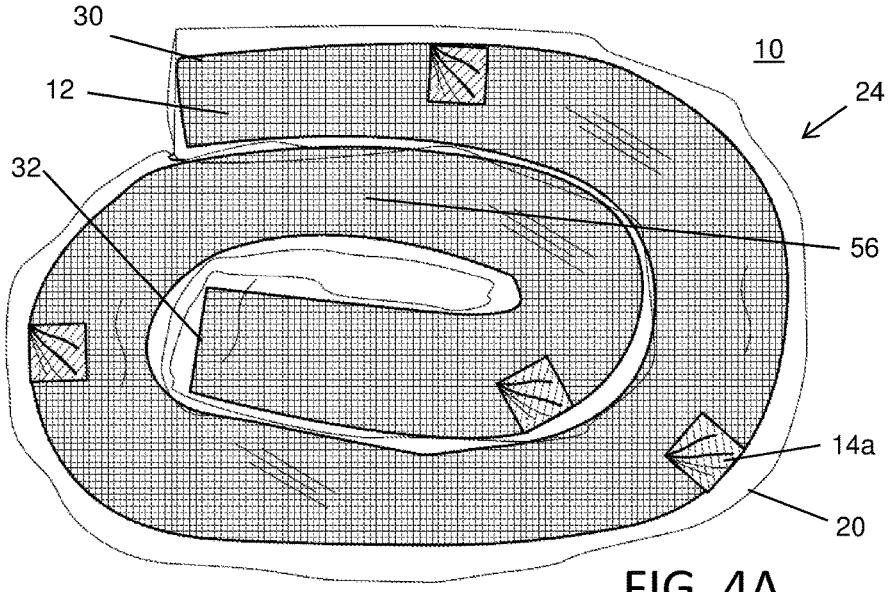
FIG. 4A shows a foam foundation for a mattress in a compact forms.

Prior to compressing the foam block as shown in FIG. 3A, the plastic membrane 20 can be placed over the foundation, and once the foam block is in the compressed configuration 40 as shown in FIG. 3B, a vacuum can be drawn and the plastic membrane can be sealed. The vacuum seal can help sustain the compressed configuration as the flexible foam block bends as it is rolled into a coil shape or otherwise wrapped or folded and packaged for storage, shipment, and delivery. Collectively, the foam block 12, preferably with the crosswise supports 14, the cover 18, and the plastic membrane 20 form a packaged foundation assembly 58. It will be appreciated that the foam foundation and packaged foundation assembly has an opened arrangement 22 and a folded arrangement 24. In the opened arrangement, the compressed packed foundation assembly has a planar form 52 as depicted in FIGS. 1-3. In the folded arrangement, the flexible foam material bends between the rigid crosswise supports, and the foam block's head side and the foot side overlap its center section 56 as shown in FIG. 4A. When folded, the packaged foundation assembly is in a compact form 54 and is secured by shipping material 60 for optimized storage, shipping and easier delivery, especially through constriction points, such as doors, stairwells, or vehicle cargo space.

Figure 4B:
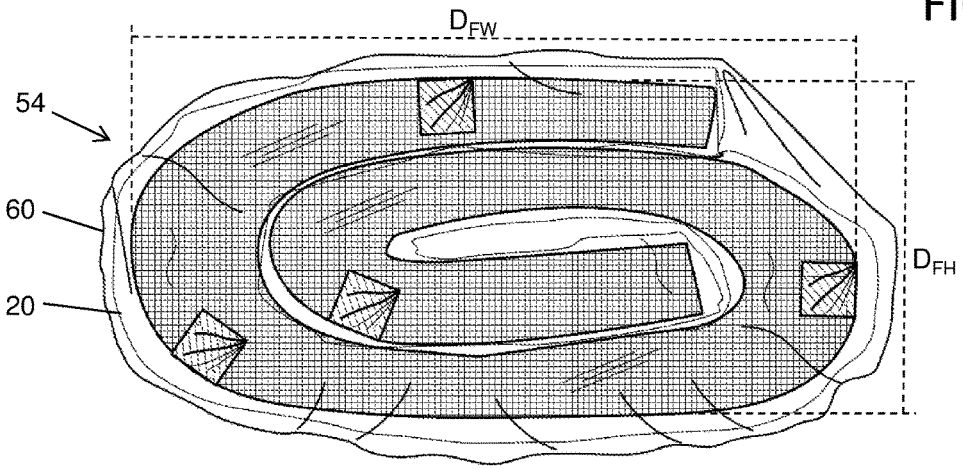
FIGS. 4B and 4C show a foam foundation for a mattress in a compact form placed in a shipping material, a plastic bag and carton respectively.
Figure 4C:
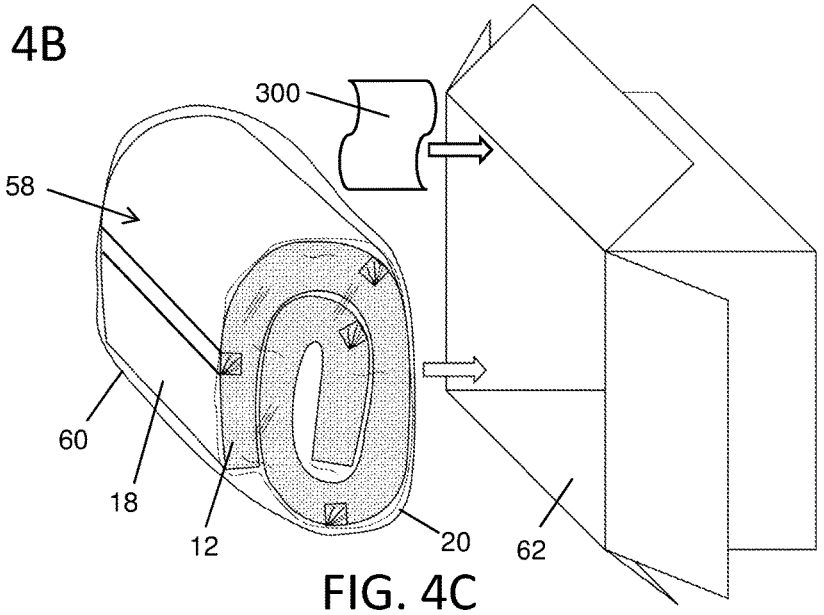

The crosswise supports maintain the rigidity of the foam foundation in the direction of the supports' axes so that the foundation can only fold around the supports' crosswise axes. Depending on the number of crosswise supports and the flexibility of the foam, the number of overlapping sections in the folds can vary. Generally, the packaged foundation assembly in its compact form has a folded height and a folded width that fit within boxes with the longest dimension being slightly larger than the width of the foam block between its sides and the other dimensions being less than half of this longest dimension. As shown in FIG. 4B, a foam foundation, compressed from its full thickness between nine and twelve inches (9"-12") down to a reduced thickness between two and three inches (2"-3"), has a compact form with a folded height $D_{FH}$ of approximately ten inches (10") which is less than twice the thickness of the full thickness of the uncompressed foam block and a folded width $D_{FW}$ of approximately twenty inches (20") which is less than the lateral width of the foam block. The foam foundation is held in its compact form and made ready to be packaged for shipment using shipping material 60 which can be any of several appropriate wraps or other binding shipping materials, such as stretch-wrapped plastic, shrink-wrapped plastic, preformed plastic bags, straps, or twine. The packaged foundation assembly is preferably placed in a shipping container 62, such as a cardboard box, for shipment. For example, as shown in FIG. 4C, the compressed and folded foam foundation in the pressure-sealed plastic can be placed into an outer plastic bag 60 and then packed in a heavy corrugated cardboard carton 62. The shipping material is preferably strong enough to keep the foundation in its compressed state in the event that the vacuum-seal breaks during shipping or while in storage.

Figure 5A:
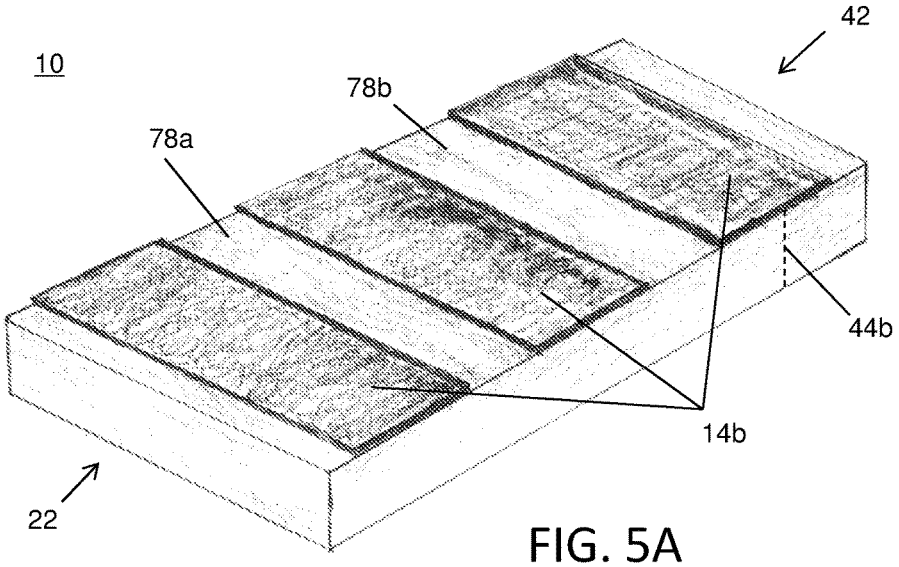
FIGS. 5A, 5B, 5C, and 5D show a foam foundation for a mattress with planar crosswise supports in an open expanded arrangement, an open compressed arrangement with a sealed plastic wrap, a folded arrangement with the plastic wrap, and the folded arrangement in a shipping bag, respectively.
Figure 5B:
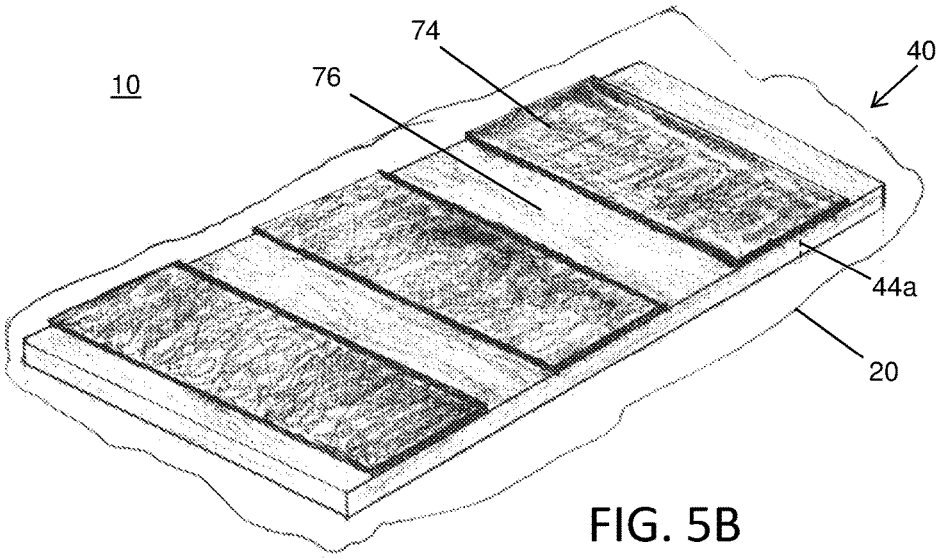

In the embodiments shown in FIGS. 1, 3, and 4, the crosswise supports are in the form of a beam support 14*a* which have a width that is less than the compressed thickness of the foam block and a thickness that is either the same as the width (i.e., a square support) or is no less than approximately one third of the beam's width. In the embodiments shown in FIGS. 2, 5, and 6, the crosswise supports are in the form of a panel support 14*b* that are wider than the compressed thickness of the foam block and are thin enough that no channel needs to be formed or cut into the foam, typically less than one quarter of the panel's width. In the embodiment shown in FIG. 5A, the crosswise supports are preferably adhered directly to the foam block. Each panel support 14*b* preferably is wider than the expanded thickness of the foam block with a supporting surface area 74 that is greater than the unsupported, exposed surface area 76 of the foam block, i.e., the supported area is greater than the unsupported area so the total panel surface area is more than half the total bottom side surface area of the foam block ($A_{pt}>½*A_{Fb}$). The crosswise supports are preferably located proximate to the head region side, center body region and foot region side as shown in FIGS. 5A and 5B. It will also be appreciated that the number of panels may vary with more than one panel in each segment of foam, such as shown in FIG. 2B, in which case the panels are only connected to each other through their attachment to the unitary foam block and not through any other structure as with the single unitary foam block described above. Additionally, as with the thicker supports described above, it will be appreciated that the planar crosswise supports can be made from any rigid material, including plastic, metals, composites, and rigid foams.

Figure 5C:
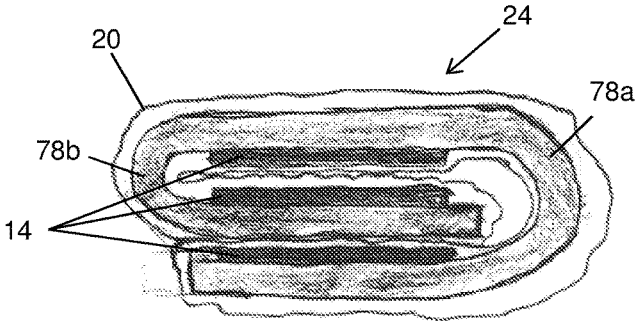
Figure 5D:
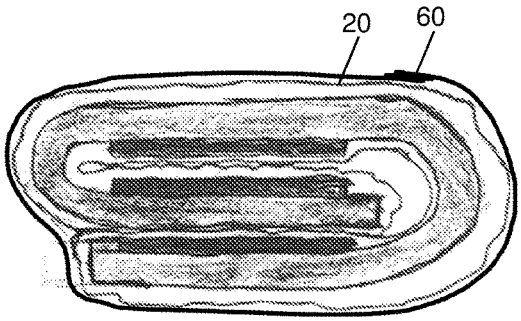

When the foundation shown in FIG. 5 having planar supports is compressed and arranged in the folded arrangement, the planar panels and respective foam sections overlap one another as depicted in FIG. 5C. Accordingly, there are gaps 78*a* and 78*b* between the planar panels allowing the foundation to be folded into the folded arrangement at the exposed region of the foam block. As with the embodiments described above, the folded foundation can be fit into a shipping bag, such as shown in FIG. 5D, and may be packaged for shipment, such as in a box as described above. Additionally, as with the embodiments described above, the distance separating the supports is preferably greater than the reduced thickness 44*a* of the foam block 12; to provide crosswise support across the span of the bed frame, the distance between the planar supports is preferably less than or equal to the foam block's full thickness 44*b* although it can be greater than this thickness for more sturdy foams with IFD values greater than 39.

Figure 6A:
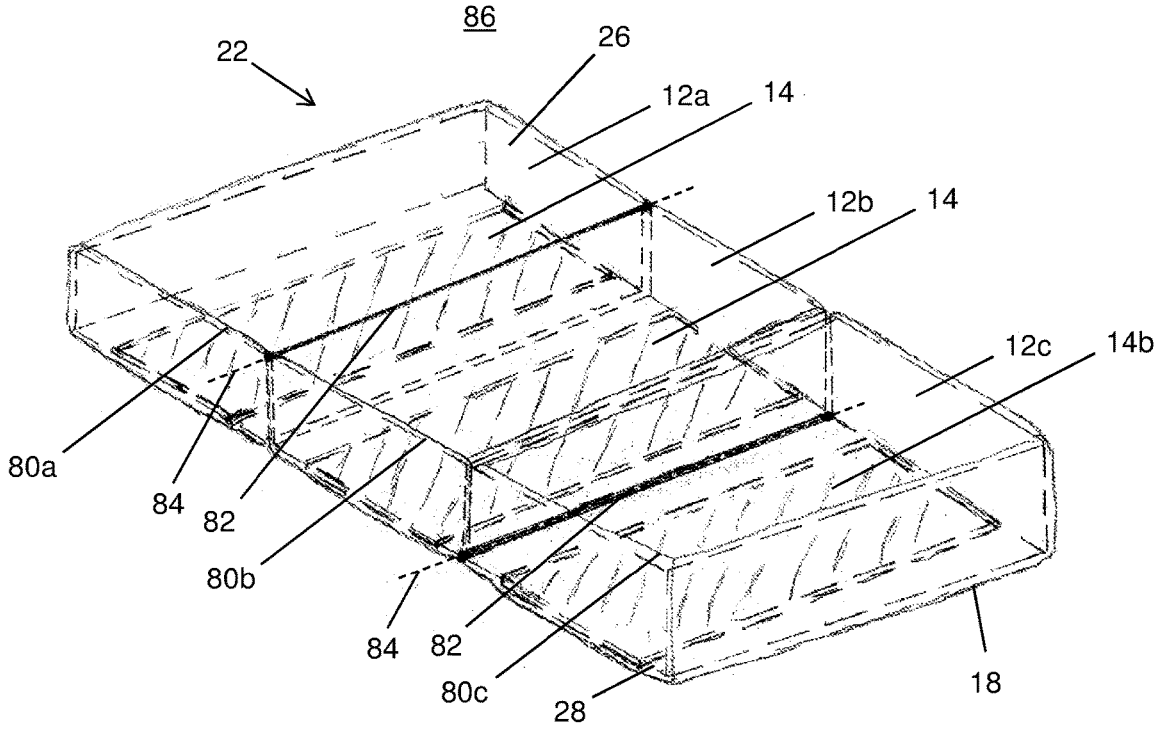
FIGS. 6A, 6B, and 6C show a segmented foam foundation for a mattress in an open arrangement, an uncompressed folded arrangement, a compressed folded arrangement, respectively.
Figure 6B:
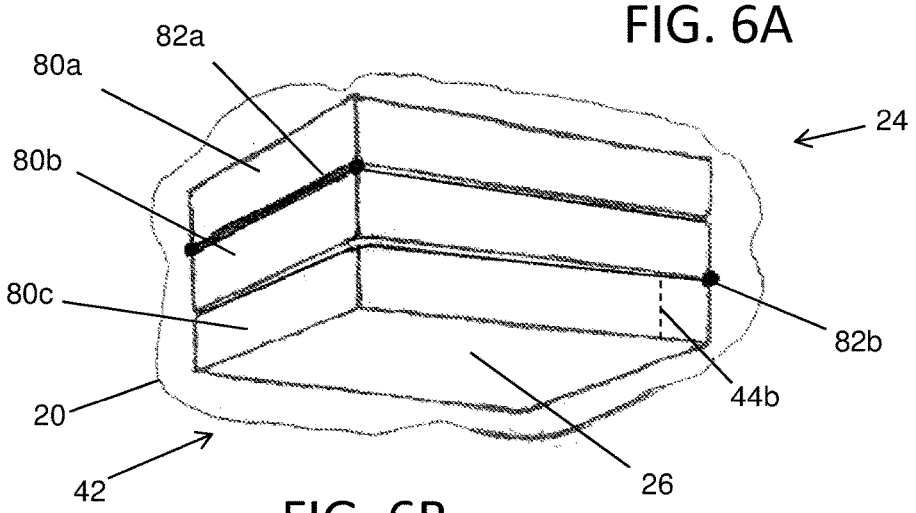
Figure 6C:
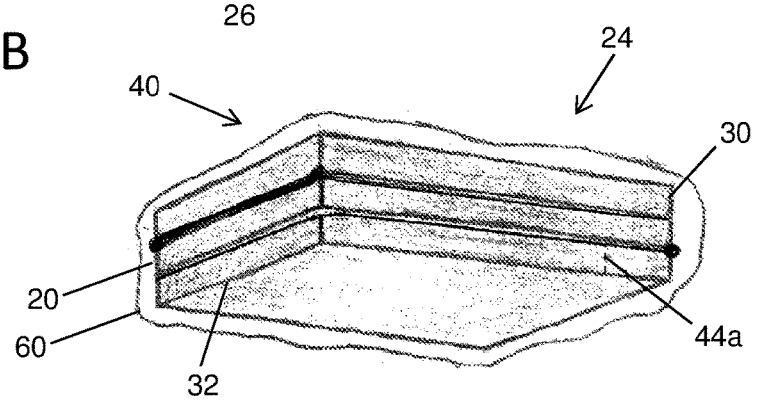

The segmented foam foundation 86 embodiment shown in FIG. 6 has multiple foam sections 12*a*, 12*b*, 12*c* that are connected by hinges 82 in the cover 18 and collectively make up a single-layer, segmented foam block. The segmented foundation preferably includes three (3) single-layer foam sections with a center section 80*b* between a head section 80*a* and a foot section 80*c*, as shown in FIG. 6A. As with the other embodiments described herein, crosswise supports are connected to the foam sections along the bottom side of the foundation. Preferably, the planar-type panel crosswise supports 14*b* are attached to corresponding foam sections 12*a*, 12*b*, 12*c*, respectively. It will be appreciated that thicker, non-planar crosswise beam supports may be used, and multiple supports may be connected to each foam section. As shown in FIG. 6A, one hinge 82 connects the head section to the center section on the top side 26 of the foundation and another hinge 82 connects the center section to the foot section on the bottom side 28 of the foundation, and the adjacent foam sections pivot about a hinge axis 84. The hinges are preferably formed with seams in the cover material and alternate between the top side and bottom side of the segmented foam foundation on opposite sides of each foam section which allows the foundation to be quickly rearranged between its unfolded arrangement and its folded arrangement, such as shown in FIGS. 6A and 6B. It will be appreciated that the foundation can be divided into more than three (3) segments with hinges that alternate between the top and bottom sides. As with the other embodiments described herein, the segmented foam foundation can also be encased in a vacuum-sealed plastic membrane 20 and compressed from its expanded configuration to its compressed configuration, such as shown in FIG. 6C.

In another aspect of the segmented foam foundation, the crosswise supports may cover the entire surface area of the corresponding foam sections and approximately abut one another in the opened arrangement. The adjacent crosswise supports may have a spacing greater than the reduced thickness of the foam block which helps in the rolling or folding of the foam block. However, with hinges in the cover at the interface between foam sections and alternating between the bottom side and the top side, no spacing or other gap between the crosswise supports is required in the segmented foam foundation embodiments other than whatever space is required for the cover that connects the adjacent foam sections.

Figure 7:
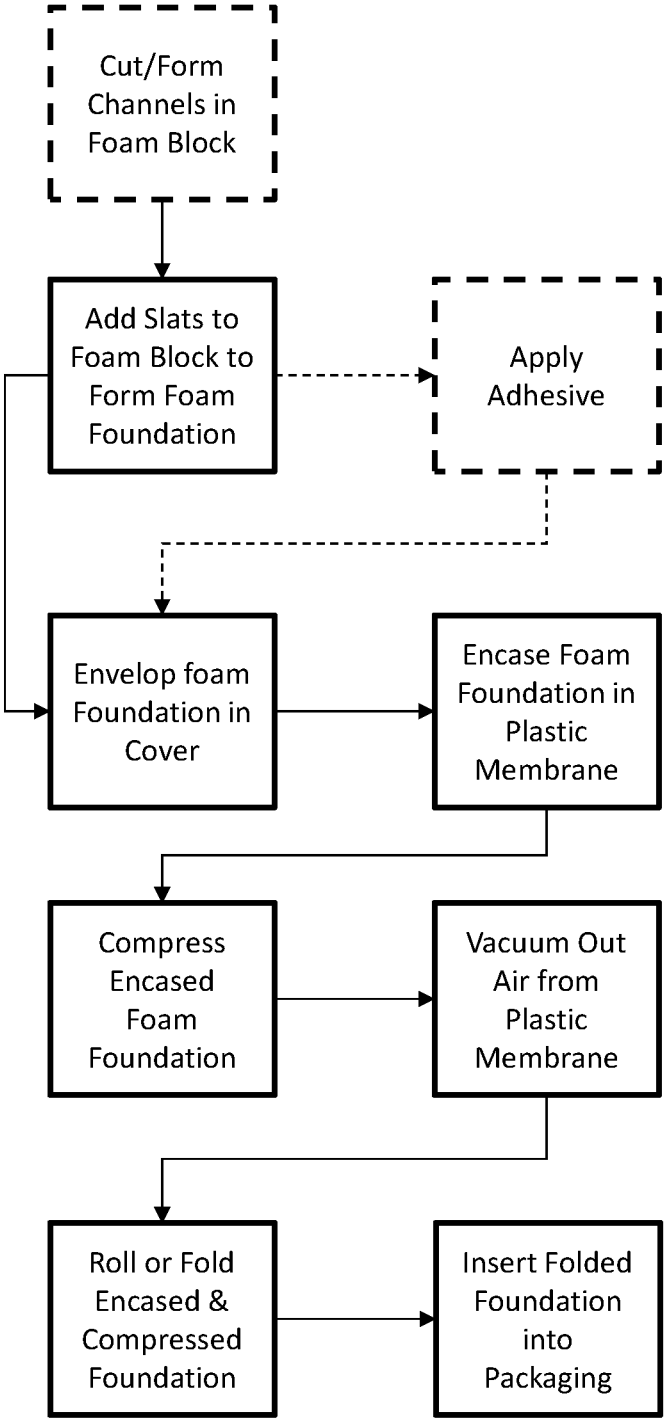
FIG. 7 illustrates steps in the method for producing a foam mattress foundation.

The present invention also provides for an inventive method for preparing a foam block for a mattress foundation as shown in FIG. 7 and according to the steps listed below.

a. Envelop the foam block with the cover while the foam block is in the expanded configuration.
b. Encase the foam block and the cover in the plastic membrane (which collectively form the packaged foundation).
c. Compress the foam block in the packaged foundation into its compressed configuration.
d. Vacuum-seal the plastic membrane.
e. Fold or roll the packaged foundation into its folded arrangement.
f. Pack the compressed and folded packaged foundation into a packing material and a shipping container for shipping and/or storage.

Generally, the above method describes how the foam foundation goes from the factory to the user with easier shipping, storage, and delivery in the compact form compared to the large and rigid prior art foundations. The vacuum-sealed plastic membrane, packing material, and shipping container are used to facilitate the shipping, storage, and delivery of the foam foundation. The compression of the foam may occur through any number of means, but pressure is preferably applied to the foundation while in the plastic membrane until the foam block reaches the desired compressed configuration. Once this compressed configuration is achieved, the plastic membrane is vacuum sealed and the pressure is removed.

The compressed vacuum-sealed foundation is folded or rolled into its folded arrangement described above which may include the crosswise supports for a packaged foundation assembly, and the vacuum-sealed plastic membrane helps maintain the foam block in its compressed configuration. The packaging material surrounding the folded, compressed vacuum-sealed foundation and the shipping container also help to maintain this configuration for storage, shipment, and delivery. The compact size of the folded, compressed vacuum-sealed foundation is a significant improvement over known mattress foundations that cannot be compressed and folded to such a compact state. Additionally, the compact foundation can be inserted into a shipping container for storage, shipment, and delivery.

The use of a single-layer, internally-homogeneous, unitary foam block to produce the foundation is beneficial over multiple layers of foam that would cost more to manufacture and assemble. Multiple layer foam structures are typically used for foam mattresses where it is more important to support a person lying on the topside of the mattress while avoiding pressure points for the person or for providing extra support in particular areas, such as along the sides of the mattress, such as disclosed by U.S. Pat. Nos. 6,662,393, 6,901,722, and 9,259,099. Additionally, the absence of any internal elongated chamber, space, or other large void in the internally-homogeneous foam block is also beneficial for the foundation. Elongated chambers or other spaces or large voids within a foam mattress can be used for inserts allowing for a different firmness than the foam block or may have a bladder that can be filled with a fluid, such as disclosed by U.S. Pat. Nos. 6,061,856 and 9,655,456 (US Pat. App. Pub. No. 2015/0015402 by Boyd). In the particular instance of the '456 Patent which discloses a polyurethane foam body having a firmness IFD between eight and seventy pounds (8-70 pounds IFD), the voids with the fluid-filled bladders would be critical when using the firmer foams with an IFD above thirty-five (35) pounds for the mattress because such a firmer foam that is unitary and internally-homogeneous, i.e., without the voids and fluid-filled bladders, would not be suitable for use as a mattress due to the hardness of the material. However, different layers of foam and variations in firmness are not necessary or even desirable for a foundation which primarily functions to provide firm and even support to the underside of a mattress that is away from the person who is lying on the topside of the mattress. The uniform, firm support provided by the foundation to the underside of the mattress could be negatively impacted by using multiple layers of foam or by having chambers allowing for variations in the firmness, and the increased cost for the foundation would make it less desirable. Applicant also notes that it would necessarily change the principle of operation of foam mattresses with multiple layers or internal chambers and would render them less suitable for their intended purposes if these mattresses were to be changed to a single layer of foam and the internal chambers were not provided.

The use of crosswise supports at the bottom side of the foam foundation combined with the higher IFD of the foam used for the foundation provides sufficient rigidity to avoid sagging between adjacent crosswise supports that could negatively impact the uniformity of the support provided to the underside of the mattress. In German utility model application DE 20 2011 052 257 U1 by Lueck GmbH, a foam mattress has crosswise supports that are fit in channels in the foam block and are connected by flexible connectors, such as textile belts or straps. These straps would provide some additional support between the crosswise supports that may help prevent sagging of the mattress, but they also add complexity to the manufacture of the structure which will result in additional costs for production and the materials and will increase the weight of the mattress. The illustrations in the Lueck reference also show a dozen crosswise supports used in a closely-spaced arrangement, and applicant notes that twelve (12) crosswise supports for a standard length mattress would result in a spacing of approximately six and one half inches (6.5") between the centerlines of the crosswise supports, less than seven inches (7) when the two (2) end crosswise supports are positioned slightly inwardly from the head side and foot side of the mattress. Based on the illustration, the crosswise supports that have widths slightly smaller than the foam sections between the supports so it is apparent that the width of each crosswise support is approximately 3" and the distance between the crosswise supports is less than four inches (4"). Due to the lower IFD of the mattress foam in Lueck, it can be appreciated that the crosswise supports for the mattress are clearly more closely spaced than the expanded thickness of the foam mattress. In comparison, in the embodiments of the present invention for the foam foundation with crosswise supports situated in channels in the foam block, the crosswise supports are widely spaced with the distance between the crosswise supports being greater than the expanded thickness of the foam foundation.

The foundation is preferably produced using a single-layer of foam as explained above, and it will be appreciated that the foundation layer with the crosswise supports at the bottom side could be combined with one or more additional layers of foam attached to the top side of the foundation layer. Such an additional layer could have an IFD in a range that is more suitable for a mattress (i.e., between 8-20 pounds for memory foam blocks and between 15-35 pounds for latex foam blocks). In comparison to the mattress layer (s), the IFD for the foundation foam block is typically above 39 pounds as indicated above. Memory foam is not typically used for foundation foams because it is not necessary for the uniform, firm support of a mattress.

Furthermore, it will be appreciated that the foundation having a flexible foam material consisting of a unitary single layer with an internally-homogenous structure, devoid of any elongated chamber or a cushion layer not only provides a less complicated manufacturing process with a single material but also provides am improved foundation without any cushioning layer that has an IFD less than thirty-nine (39) pounds which would negatively impact the ability of the foundation to provide support to a separate mattress. Other prior art references, such as the Boyd '402 Application, teach composite foam mattresses have more complicated structures that include one or more layers of higher IFD foams which provide structural support and that also include lower IFD cushioning layers which provide comfort to the sleeper. Composite mattresses are not capable of functioning satisfactorily as a foundation for a separate mattress structure because they cannot provide the firm structural support that is required of the foundation by the separate mattress. Additionally, the cushioning side of the mattress cannot be flipped because it is permanently attached at its lower layer to the top of the firmer foam. By nature, the lower IFD cushioning layers are not as firm as the foundation IFD, and any inclusion of cushioning layers reduces the effectiveness of the overall structure to function as a foundation. It will also be appreciated that when the cushioning side of the composite mattress is no longer performing satisfactorily, the entire composite mattress would need to be replace even if the firmer side continues to provide satisfactory structural support; in comparison, with the separate foundation structure of the present invention, a mattress can be can be replaced and/or flipped.

Even in alternative embodiments of the foundation described herein that include a scrim material or other fabric attached to the foam block by an adhesive layer between the fabric and the foam block, the foundation remains devoid of any cushioning layer. Thus, the foam block consists of only the flexible foam material having no cushion layer between the top side of the foam block and the cover. Any additional layer that is between the foam block and the cover, such as the scrim layer, is a flexible fabric material with a thickness that is less than the thickness of the cover. Accordingly, it will be understood by those having an ordinary skill in the art that such a thin layer of flexible material is neither a supporting foam nor a cushioning layer so it is not measured by IFD and instead serves an entirely separate function which may include but is not limited to fire retardation, moisture-resistance, and/or bed bug protection.

Figure 8:
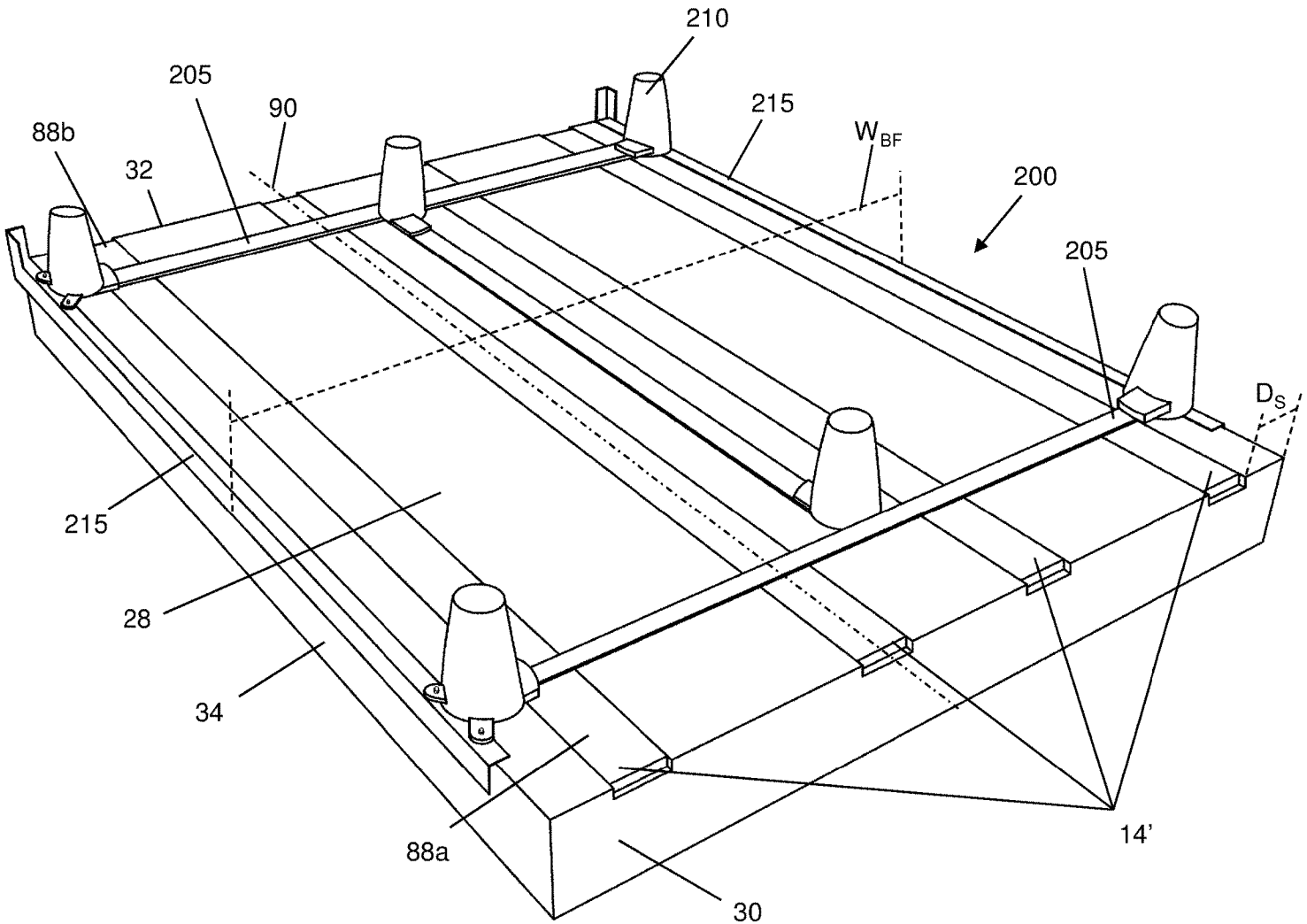
FIG. 8 illustrates an underside view of a foam foundation with longitudinal crosswise supports engaging a bed frame with lateral crossbars.
Figure 9:
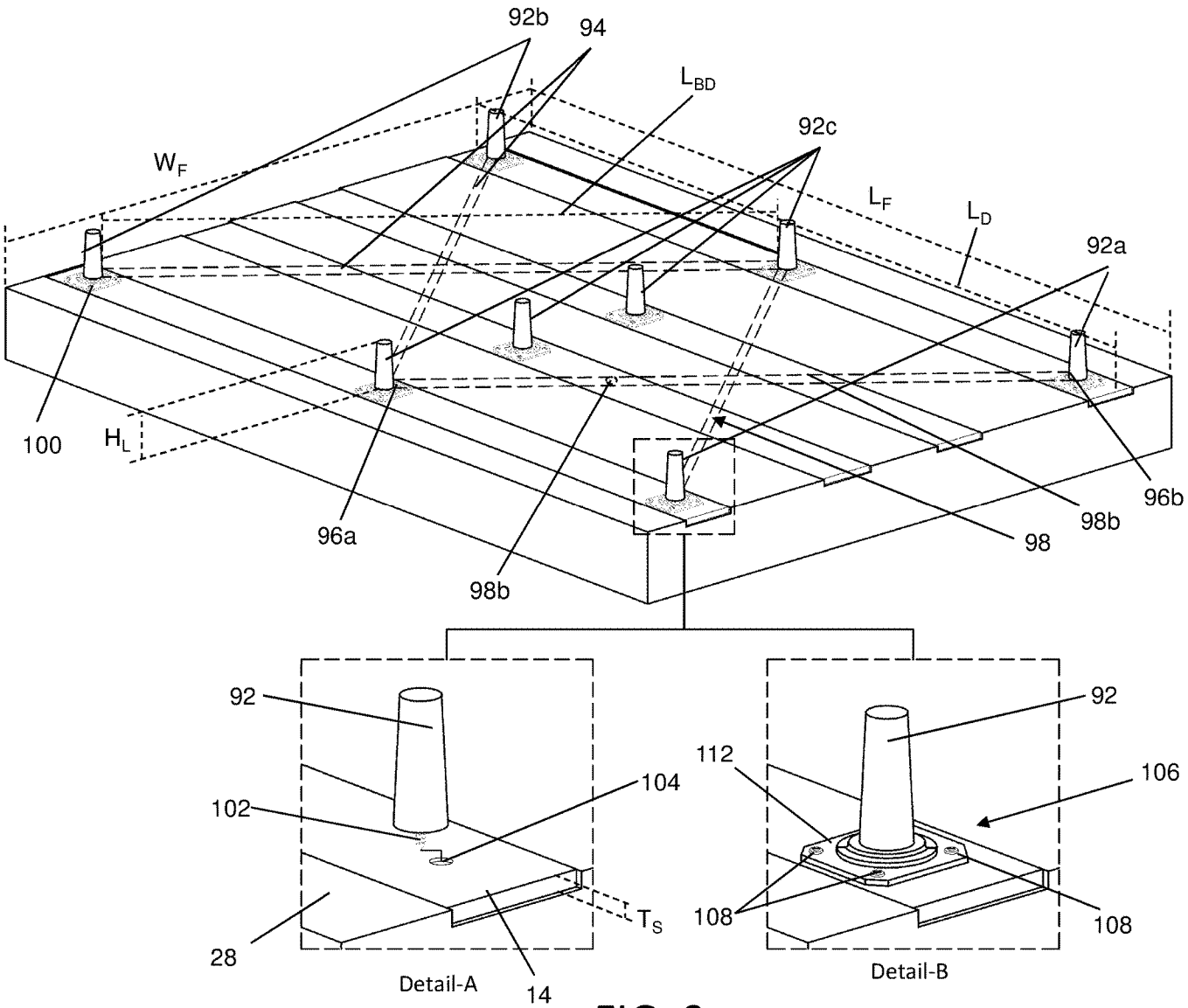
FIG. 9 illustrates an underside view of a foam foundation with longitudinal crosswise supports and support legs with detail views of optional connections for the support legs.

In the embodiments of the foundation shown in FIGS. 8 and 9, the crosswise rigid supports are longitudinal supports 14' on the bottom side of the foam block and extend the length of the foundation rather than extending laterally between the sides of the foam block as described above. The longitudinal crosswise supports have a longitudinal dimension ($L_D$) approximately equal to the foundation length ($L_F$) of the foam block with one end proximal 88*a* to the head side of the foam foundation and the opposite end proximal 88*b* to the foot side of the foam foundation. Similar to the lateral supports, these longitudinal supports act as a skeletal structure and provide rigid structure to the foam foundation, but have a thickness ($T_S$) that are thin enough to allow the foundation to be compressed to its reduced thickness, preferably less than 2" or 3".

As explained in detail with regard to the lateral crosswise supports discussed above, there are no rigid connections between the longitudinal crosswise supports so that the flexible foam block can be rolled even when the rigid supports are connected to the foam block and the unit can be stowed into a shipping arrangement as the foundation rolls in the lateral direction around the axes of the longitudinal supports 90. Once rolled the foundation will be in a folded arrangement with one side section along one side edge and another side section along the opposite side edge of the foundation overlapping a longitudinal center section of the foundation. Depending on the number of longitudinal crosswise supports and the flexibility of the foam, additional overlapping sections may be used between the folds.

The longitudinal crosswise supports extend between the head side and the foot side of the foundation and therefore allow the foundation to be used with bed frames 200 that may not necessarily have a width that is approximately equal to the lateral width of the foundation. Persons having an ordinary skill in the art will appreciate that bed frames that have varying lateral widths present problems when lateral crosswise supports are used. For example, if the lateral width of the bed frame ($W_{BF}$) is greater than the lateral width of the foundation ($W_F$), lateral crosswise supports will not span the gap between the opposite sides of the bed frame and therefore will be unable to provide additional support to the foundation and mattress. Further, sides of a bed frame may angle away from one another from head side to foot side, or vice versa, allowing the lateral supports to properly span the gap between one end of the frame but be unable to span the gap on the opposite end. With the varying lateral widths of the bed frame, the lateral crosswise supports could be rendered less effective than is desired for the foundation.

Longitudinal crosswise supports combat the issue of varying frame widths as these longitudinal supports intersect and contact the lateral crossbars of the bed frame that connect the opposing sides and provide support even when the bed frame is not specifically sized for the foundation or if it is not perfectly square. As shown in FIG. 8, a standard bedframe traditionally has at least two crossbars 205 extending between the two side sections of the frame that are positioned interiorly of the head end and foot end of the frame with legs 210 connected thereto. Accordingly, the length of the foundation is not limited but the width is restricted to the distance between the side sections 215 of the frame. Longitudinal crosswise supports therefore allow a foundation with a lateral width that is less than the width of the frame to be used within the frame because the crosswise supports are supported by the lateral crossbars rather than by the opposing side sections of the frame. Rather than having lateral crosswise supports that run parallel to the crossbars and are supported on each end by the side sections of the frames, the longitudinal crosswise supports need only rest on the lateral crossbars of the bed frame where one crossbar is traditionally proximal the head side and another crossbar is proximal the foot side. Thus, the foundation can still be used even if the foundation width does not span the width of the frame.

Alternatively, although the FIG. 8 depicts a preferred embodiment with the bed frame particularly sized to match the size of the foundation, it will be appreciated that a foundation with longitudinal crosswise supports can be used with a bed frame having a lateral width that is smaller than the width of the foundation wherein the foundation can be slightly compressed on the opposing sides to fit within the frame. As shown in the drawings, the longitudinal crosswise supports are spaced a distance away from the side edges ($D_S$) of the foundation and there is no interference from the crosswise supports that would prevent compression of the foundation to fit within frame that is more narrow than the foundation width.

The longitudinal crosswise supports also provide added support to the foundation and mattress where they operate in concert with the lateral crossbars of the frame. The crossbars not only connect the opposing sides of the frame but also provide support to foundation as explained above. The longitudinal crosswise supports therefore supplement the lateral support provided by the crossbars by further supporting the foundation, mattress and weight thereon in the spaces between the lateral crossbars. Thus, the foundation, mattress and weight thereon are supported laterally by the frame cross bars and longitudinally by the longitudinal crosswise supports.

In another embodiment particularly shown FIG. 9, legs 92 connect to the underside of the crosswise supports and raise the foundation off the ground the leg height ($H_L$) while providing additional support to the foundation. The legs can be used on their own, in combination with a standard bed frame, or with braces 94 that are attached to the legs and the crosswise supports beneath the underside of the foundation. In the preferred embodiment shown in FIG. 9, a first set of legs 92*a* are positioned towards the head side of the foundation and a second set of legs 92*b* are positioned towards the foot side of the foundation. In addition, a third set of legs 92*c* are be provided between the first set and second set, proximate to the middle of the foundation, equidistant from the opposing head and foot ends. Although only three sets of legs are depicted in FIG. 9, it will also be appreciated that additional legs could be positioned anywhere on the crosswise supports. Furthermore, although the legs depicted in the FIG. 9 are used in combination with longitudinal crosswise supports, it will also be appreciated that the legs may be connected to a foundation having lateral crosswise supports without altering the scope of the present invention.

When braces 94 are provided between sets of legs, additional structural support is provided without necessarily using a separate frame structure. In operation, the rigid braces connect between a pair of legs beneath the foam block at opposing brace ends 96*a* and 96*b* and preferably includes a longitudinal brace dimension ($L_{BD}$) between the opposing ends that is greater than one-half the lateral width of the foam block. To provide further structural support, it is also preferred that each brace intersect and contact at least one of the crosswise supports at a mounting point 98 and may connect thereto with a fastener 98*a* or may simply rest against the crosswise support 98*b* and support the same. It will also be appreciated that braces could connect between pairs of legs without intersecting a crosswise support or could be situated underneath the crosswise supports.

In operation, the legs connect to the underside of the crosswise supports with fasteners that allow the legs to be securely connected thereto in an assembled arrangement and released for shipping or storage. Accordingly, the legs can be separated from the foam block and shipped within the interior space of the shipping container along with the packaged foundation in the folded arrangement and crosswise supports as described in detail above. Similarly, braces are releasably connected to respective legs with fasteners and can be disassembled for shipping or storage within the shipping container. Further still, additional fasteners can be used to physically connect the braces to the crosswise supports at the mounting points between the opposing brace ends if a sturdier configuration is desired than when the crosswise supports simply rest on the mounting points as described above. Thus, foundations which use braces in combination with the legs are more similar to the support structure and frames that are used in furniture with legs, such as couches, but do not require a separate skeletal structure that is not included in the shipping container containing the foundation.

Although the particular fastener type 100 is not intended to be limiting and persons having an ordinary skill in the art will appreciate that numerous fasteners may be combined with the teachings of the present invention to releasably attach the legs and braces together and to the crosswise supports, the preferred fasteners include a threaded post and bracket. As shown in Detail-A of FIG. 9, the legs may include a threaded post 102 extending from the top side which screw into a threaded bore hole 104 in the crosswise support and thereby connect to the foundation. Alternatively, as shown in Detail-B of FIG. 9, the leg may be connected with a bracket 106 fixed to or integrated with the top side of the post with screws 108 extending through apertures 110 around the perimeter of the bracket 112 and into the crosswise support.

Further still, the foundation with legs described herein and shown in FIG. 9 may also be used in combination the traditional bed frame shown in FIG. 8, with or without braces extending between the legs. For example, individual legs may be connected at the ends of each longitudinal crosswise support or at any point between the opposing ends so long as the legs do not interfere with the frame sections. Furthermore, braces may still extend between the legs so long as they are particularly arranged so that they do not intersect the frame sections. When such a combination is made, it will be appreciated that the leg height may necessarily be varied to match the height of the frame so it will further be appreciated that the legs may be adjustable by any known means, such as with an adjustable bracket used to connect to the legs to the crosswise supports, telescoping legs or any other height varying means.

In the preferred embodiment depicted in FIG. 9, four (4) diagonal braces extend between respective legs positioned at the head side, foot side and middle of the foundation. Further, each brace intersects two (2) crosswise supports situated between the brace ends and therefore contact each of the four crosswise supports either directly at the intersection point or via the legs at opposing ends of the brace. As indicated above, the ends of the braces can be secured to the crosswise supports with separate fasteners or brackets. However, in the preferred embodiment, the brackets and/or threaded posts that connects the legs to the crossbeam supports are also used to connect secure the braces to the crosswise supports. The braces are preferably metal; however, similar to the crosswise supports, the braces may be made from any number of rigid materials including but not limited to woods, plastics, metals, hardened foams, composites, and other similar materials.

The embodiments of the foam foundation were chosen and described to best explain the principles of the invention and its practical application to persons who are skilled in the art. As various modifications could be made to the exemplary embodiments, as described above, without departing from the scope of the invention, it is intended that all matter contained in the foregoing description and shown in the accompanying drawings shall be interpreted as illustrative rather than limiting. Additionally, for bed frames that already have crosswise supports or have a platform or a web across the frame, the compact configuration of the foam in a cover could be packaged with instructions 300 in place of the crosswise supports that explain the seating of the foundation on spaced crosswise supports or other frame options to properly support the mattress. The crosswise supports provide crosswise rigidity, but they are not rigidly connected to each other and are only connected to each other through the foam material, or the foam and cover for the segmented foam foundation. The present invention has additional advantages over traditional mattress foundations. Thus, the breadth and scope of the present invention should not be limited by any of the above-described exemplary embodiments, but should be defined only in accordance with the following claims appended hereto and their equivalents.

What is claimed is:

1. A foundation for supporting a mattress, comprising:

a foam block comprising a top side, a bottom side, a head side, a foot side, a pair of side edges, a lateral width, and a longitudinal length, wherein the head side and the foot side are separated by the foundation length, wherein the pair of side edges are separated by the lateral width, wherein the foam block further comprises a flexible foam material having an indentation force deflection greater than thirty-nine pounds and less than ninety-five pounds, wherein the foam block has a compressed configuration and an expanded configuration, wherein the top side and the bottom side are separated by a first thickness of the foam block in the compressed configuration and a second thickness of the foam block in the expanded configuration, and wherein the second thickness is greater than the first thickness; and a plurality of crosswise supports connected to the bottom side of the foam block, wherein each one of the crosswise supports has a longitudinal dimension approximately equal to at least one of the foundation length, the lateral width of the foam block, and any longitudinal dimension between the foundation length and the lateral width, wherein the crosswise supports extend along one of the lateral width and the longitudinal length of the foam block, wherein the plurality of crosswise supports are only connected to each other through their connection to the foam block, and wherein at least one pair of adjacent crosswise supports are spaced apart at a distance greater than the second thickness of the foam block in the expanded configuration and less than the lateral width of the foam block.

2. The foundation of claim 1 further comprising a plurality of legs and a plurality of braces respectively connected between a pair of legs from the plurality of legs beneath the foam block at a pair of brace ends, wherein each one of the braces comprises a longitudinal dimension between the pair of brace ends greater than one-half the lateral width of the foam block and a mounting point between the pair of brace ends, and wherein each one of the braces intersect at least one crosswise support and contact the underside of the crosswise support at the mounting point.

3. The foundation of claim 2, wherein the plurality of fasteners comprise a bracket having a fixed section connected to a top portion of the leg and a set of screws, wherein the fixed section comprises a set of apertures offset from a perimeter of the top portion of the leg, and wherein the set of screws extend through the set of apertures and threadingly connect to the underside of the crosswise supports.

4. The foundation of claim 2, wherein the plurality of fasteners comprise a threaded post fixedly attached to one of the top portion of the leg and the underside of the crosswise support, and wherein the threaded post threadingly connects to a threaded bore within the other of the top portion of the leg and the underside of the crosswise support.

5. The foundation of claim 1 further comprising a plurality of legs and a plurality of fasteners releasably connecting each of plurality of legs to the underside of the plurality of crosswise supports, wherein a first set of legs are situated proximal to the head side of the foam block, wherein a second set of legs are situated proximal to the foot side of the foam block, and wherein a third set of legs situated between the first set of legs and the second set of legs.

6. The foundation of claim 1 further comprising a cover enveloping the foam block and a vacuum-seal plastic membrane encasing the foam block and the cover when the foam block is in the compressed configuration forming a packaged foundation and a shipping container having an interior space, wherein the packaged foundation has an opened arrangement and a folded arrangement, wherein the foam block has a planar form in the opened arrangement, wherein one of the head side and a longitudinal side edge in the pair of sides and one of the foot side and another longitudinal side edge in the pair of sides of the foam block overlap a center section of the foam block in the folded arrangement, and wherein the packaged foundation in the folded arrangement and the plurality of crosswise supports fit in the interior space of the shipping container.

7. The foundation of claim 1, wherein the foam block further comprises a unitary, single layer of the flexible foam material having an internally-homogenous structure without any elongated chamber within the foam block.

8. The foundation of claim 1, wherein the plurality of crosswise supports are metal.

9. The foundation of claim 1, wherein the bottom side of the foam block comprises a plurality of channels recessed into the foam block at spaced apart locations, wherein the channels extend along one of the foundation length and the lateral width of the foam block respectively corresponding with the crosswise supports extending along the lateral width and the longitudinal length of the foam block, wherein each one of the plurality of crosswise supports has a plurality of sides respectively contacting the channels and an outer-facing side not in contact with the sidewalls, wherein the outer-facing side of the plurality of crosswise supports is substantially flush with a surface of the bottom side of the foam block, and wherein each one of the crosswise supports has a width less than the second thickness of the foam block in the expanded configuration.

10. The foundation of claim 1, wherein each one of the crosswise supports has a width greater than the second thickness of the foam block in the expanded configuration and is attached directly to a surface of the bottom side of the foam block, and wherein a total surface area of the crosswise supports in contact with the foam block is greater than one half an entire surface area of the bottom side of the foam block and is less than the entire surface area.

11. A foundation for supporting a mattress, comprising:

a foam block comprising a top side, a bottom side, a head side, a foot side, a pair of side edges, a lateral width, and a longitudinal length, wherein the head side and the foot side are separated by the foundation length, wherein the pair of side edges are separated by the lateral width, wherein the foam block further comprises a flexible foam material having an indentation force deflection greater than thirty-nine pounds and less than ninety-five pounds, wherein the foam block has a compressed configuration and an expanded configuration, wherein the top side and the bottom side are separated by a first thickness of the foam block in the compressed configuration and a second thickness of the foam block in the expanded configuration, and wherein the second thickness is greater than the first thickness;

a plurality of crosswise supports connected to the bottom side of the foam block, wherein each one of the crosswise supports has a longitudinal dimension approximately equal to at least one of the foundation length, the lateral width of the foam block, and any longitudinal dimension between the foundation length and the lateral width, wherein the crosswise supports extend along one of the lateral width and the longitudinal length of the foam block, and wherein at least one pair of adjacent crosswise supports are spaced apart at a distance greater than the second thickness of the foam block in the expanded configuration and less than the lateral width of the foam block;

a plurality of legs connected to an underside of the plurality of crosswise supports, wherein a first set of legs are situated proximal to the head side of the foam block, wherein a second set of legs are situated proximal to the foot side of the foam block;

a plurality of braces respectively connected between a pair of legs from the plurality of legs and the underside of at least one crosswise support; and a cover enveloping the foam block and a vacuum-seal plastic membrane encasing the foam block and the cover when the foam block is in the compressed configuration forming a packaged foundation and a shipping container having an interior space, wherein the packaged foundation has an opened arrangement and a folded arrangement, wherein the foam block has a planar form in the opened arrangement, wherein one of the head side and a longitudinal side edge in the pair of sides and one of the foot side and another longitudinal side edge in the pair of sides of the foam block overlap a center section of the foam block in the folded arrangement, and wherein the packaged foundation in the folded arrangement, the plurality of crosswise supports, the plurality legs and the plurality of braces fit in the interior space of the shipping container.

12. The foundation of claim 11, wherein the plurality of braces further comprise a pair brace ends, a plurality of mounting points between the pair of brace ends, and a longitudinal dimension between the pair of brace ends greater than one-half the lateral width of the foam block and, and wherein each one of the braces intersect and contact a set of crosswise supports from the plurality of crosswise support at respective mounting points from the plurality of mounting points.

13. The foundation of claim 11 further comprising a third set of legs situated between the first set of legs and the second set of legs and a plurality of fasteners releasably connecting each of plurality of legs to the underside of the plurality of crosswise supports.

14. The foundation of claim 13, wherein the fasteners are selected from the group consisting of a bracket and a threaded post, wherein the bracket comprises a fixed section connected to a top portion of the leg and a set of screws, wherein the fixed section comprises a set of apertures offset from a perimeter of the top portion of the leg, wherein the set of screws extend through the set of apertures and threadingly connect to the underside of the crosswise supports, wherein the threaded post fixedly attaches to one of the top portion of the leg and the underside of the crosswise support, and wherein the threaded post threadingly connects to a threaded bore within the other of the top portion of the leg and the underside of the crosswise support.

15. The foundation of claim 11, wherein the plurality of crosswise supports are only connected to each other through their connection to the foam block.

16. The foundation of claim 11, wherein the bottom side of the foam block comprises a plurality of channels recessed into the foam block at spaced apart locations, wherein the channels extend along one of the foundation length and the lateral width of the foam block respectively corresponding with the crosswise supports extending along the lateral width and the longitudinal length of the foam block, wherein each one of the plurality of crosswise supports has a plurality of sides respectively contacting the channels and an outer-facing side not in contact with the sidewalls, wherein the outer-facing side of the plurality of crosswise supports is substantially flush with a surface of the bottom side of the foam block, and wherein each one of the crosswise supports has a width less than the second thickness of the foam block in the expanded configuration.

17. A foundation for supporting a mattress, comprising:

a foam block comprising a top side, a bottom side, a head side, a foot side, a pair of side edges, a lateral width, and a longitudinal length, wherein the head side and the foot side are separated by the foundation length, wherein the pair of side edges are separated by the lateral width, wherein the foam block further comprises a flexible foam material having an indentation force deflection greater than thirty-nine pounds and less than ninety-five pounds, wherein the foam block has a compressed configuration and an expanded configuration, wherein the top side and the bottom side are separated by a first thickness of the foam block in the compressed configuration and a second thickness of the foam block in the expanded configuration, wherein the second thickness is greater than the first thickness, wherein the flexible foam material consists of a unitary single layer having an internally-homogenous structure without any elongated chamber and without a cushion layer, and wherein the cushion layer is any material layer having an indentation force deflection less than thirty-nine pounds;

a cover enveloping the foam block;

a vacuum-seal plastic membrane encasing the foam block and the cover when the foam block is in the compressed configuration forming a packaged foundation, wherein the packaged foundation has an opened arrangement and a folded arrangement, wherein the foam block has a planar form in the opened arrangement, and wherein a center section of the foam block is overlapped in the folded arrangement either by the pair of side edges or by the head side and the foot side; and a shipping container having an interior space, wherein the packaged foundation in the folded arrangement fits in the interior space of the shipping container.

18. The foundation of claim 17 further comprising a plurality of crosswise supports connected to the bottom side of the foam block, wherein each one of the crosswise supports has a longitudinal dimension approximately equal to at least one of the foundation length, the lateral width of the foam block, and any longitudinal dimension between the foundation length and the lateral width, wherein the crosswise supports extend along one of the lateral width and the longitudinal length of the foam block, and wherein at least one pair of adjacent crosswise supports are spaced apart at a distance greater than the second thickness of the foam block in the expanded configuration and less than the lateral width of the foam block.

19. The foundation of claim 18 further comprising a plurality of legs connected to an underside of the plurality of crosswise supports, wherein a first set of legs are situated proximal to the head side of the foam block, and wherein a second set of legs are situated proximal to the foot side of the foam block.

20. The foundation of claim 17, wherein the foundation comprises a flexible material layer between the foam block and the cover, wherein the flexible material layer comprises a thickness that is less than a thickness of the cover, and wherein no cushioning layer is between the cover and the foam block.

* * * * *